US008801025B2

(12) United States Patent
Mårs

(10) Patent No.: US 8,801,025 B2
(45) Date of Patent: Aug. 12, 2014

(54) SKI OR SKATE BINDING

(75) Inventor: Per Mårs, Östersund (SE)

(73) Assignee: Marsblade AB, Ostersund (SE)

( * ) Notice: Subject to any disclaimer, the term of this patent is extended or adjusted under 35 U.S.C. 154(b) by 0 days.

(21) Appl. No.: 13/578,493

(22) PCT Filed: Mar. 15, 2012

(86) PCT No.: PCT/SE2012/000036
§ 371 (c)(1),
(2), (4) Date: Sep. 30, 2013

(87) PCT Pub. No.: WO2012/128690
PCT Pub. Date: Sep. 27, 2012

(65) Prior Publication Data

US 2014/0015227 A1 Jan. 16, 2014

(30) Foreign Application Priority Data

Mar. 18, 2011 (SE) ..... 1150246

(51) Int. Cl.
*A63C 1/28* (2006.01)

(52) U.S. Cl.
USPC ..... 280/611; 280/607; 280/613; 280/618

(58) Field of Classification Search
CPC ..... A63C 17/06; A63C 9/02; A63C 17/065; A63C 17/061; A63C 1/22; A63C 1/28; A43B 5/1641; A43B 5/1658
USPC ..... 280/611, 613, 636, 631, 618, 615, 607, 280/11.15, 11.14, 11.3
See application file for complete search history.

(56) References Cited

U.S. PATENT DOCUMENTS

| | | | | |
|---|---|---|---|---|
| 304,014 | A | 8/1884 | Lincoln | |
| 2,093,915 | A * | 9/1937 | Klevstad | 280/11.14 |
| 2,725,238 | A | 11/1955 | Day | |
| 3,822,491 | A * | 7/1974 | Rathmell | 36/117.4 |

(Continued)

FOREIGN PATENT DOCUMENTS

| | | |
|---|---|---|
| CA | 2314631 A1 | 1/2001 |
| CN | 2093669 U | 1/1992 |

(Continued)

OTHER PUBLICATIONS

International Search Report for international patent application No. PCT/SE2011/000016 dated May 18, 2011.

(Continued)

*Primary Examiner* — J. Allen Shriver, II
*Assistant Examiner* — Steve Clemmons
(74) *Attorney, Agent, or Firm* — Harness, Dickey & Pierce, P.L.C.

(57) ABSTRACT

A binding for a vehicle, such as a skate for skating on ice or a ski. The binding has an upper chassis section and a lower chassis section, which are interconnected by means of coupling means. The upper chassis section and the lower chassis section are arranged to be rollable relative to each other in the vehicle's longitudinal direction. The binding includes a first and a second contact surface at least one of the first and the second contact surface being curved. Thereby a stepless rolling motion between the upper chassis and the lower chassis is provided for, allowing the chassis to rock both backwards and forwards in relation to each other.

19 Claims, 13 Drawing Sheets

(56) References Cited

U.S. PATENT DOCUMENTS

| | | | | | |
|---|---|---|---|---|---|
| 4,396,204 | A | | 8/1983 | Smirnykh | |
| 4,602,801 | A | | 7/1986 | Vincent | |
| 4,691,931 | A | | 9/1987 | Vincent | |
| 4,706,974 | A | | 11/1987 | Vincent | |
| 5,123,664 | A | * | 6/1992 | DeMars | 280/11.18 |
| 5,125,680 | A | * | 6/1992 | Bejean et al. | 280/615 |
| 5,135,244 | A | | 8/1992 | Allison | |
| 5,232,231 | A | | 8/1993 | Carlsmith | |
| 5,639,104 | A | | 6/1997 | Haldemann | |
| 5,755,449 | A | | 5/1998 | Pozzobon | |
| 5,890,724 | A | * | 4/1999 | Gignoux et al. | 280/11.28 |
| 5,927,728 | A | | 7/1999 | Gignoux et al. | |
| 5,979,916 | A | | 11/1999 | Gatel et al. | |
| 6,007,075 | A | | 12/1999 | Shum | |
| 6,113,111 | A | * | 9/2000 | Gierveld et al. | 280/11.15 |
| 6,152,458 | A | * | 11/2000 | Edauw et al. | 280/11.14 |
| 6,227,550 | B1 | | 5/2001 | Maggiolo | |
| 6,523,835 | B1 | | 2/2003 | Lyden | |
| 6,561,525 | B1 | | 5/2003 | Chou | |
| 6,736,412 | B1 | | 5/2004 | Krah | |
| 6,843,497 | B1 | * | 1/2005 | Riepler | 280/615 |
| 6,971,652 | B2 | | 12/2005 | Bobbert et al. | |
| 7,270,343 | B2 | | 9/2007 | Riepler | |
| 7,419,187 | B2 | * | 9/2008 | Haugen et al. | 280/841 |
| 2003/0116941 | A1 | * | 6/2003 | Mash | 280/607 |
| 2005/0051996 | A1 | * | 3/2005 | Riepler | 280/615 |
| 2005/0206109 | A1 | | 9/2005 | Mash | |
| 2013/0344774 | A1 | | 12/2013 | Allen | |

FOREIGN PATENT DOCUMENTS

| | | | | |
|---|---|---|---|---|
| CN | 1094982 | A | | 11/1994 |
| DE | 78733 | | | 12/1984 |
| DE | 29614090 | U1 | | 1/1997 |
| DE | 29814854 | U1 | | 1/1999 |
| EP | 230989 | A2 | * | 8/1987 |
| EP | 0786275 | | | 7/1997 |
| EP | 0795348 | | | 9/1997 |
| EP | 0903168 | A1 | | 3/1999 |
| EP | 1319424 | A1 | | 6/2003 |
| FR | 2758093 | A1 | * | 7/1998 |
| FR | 2816516 | A1 | | 5/2002 |
| NL | 8702068 | A | | 4/1989 |
| WO | WO 00/09223 | | | 2/2000 |
| WO | WO-2007/137834 | A1 | | 12/2007 |
| WO | WO 2010124382 | A1 | * | 11/2010 |

OTHER PUBLICATIONS

Office Action for co-pending U.S. Appl. No. 13/384,457 dated June. 26, 2013.

International Search Report PCT/ISA/210 for International Application No. PCT/SE2012/000036 dated Jun. 12, 2012.

Written Opinion of the International Search Authority PCT/ISA/237 for International Application No. PCT/SE2012/000036 dated Jun. 12, 2012.

Office Action for co-pending U.S. Appl. No. 13/384,457 dated Apr. 10, 2014.

Notice of Allowance for co-pending U.S. Appl. No. 14/013,608 mailed Jun. 5, 2014.

Chinese Office Action for Chinese Application No. 201180008556.X dated May 9, 2014.

* cited by examiner

SKI OR SKATE BINDING

FIELD OF THE INVENTION

The present invention relates to an integrated or separate binding for the attachment of a shoe to a skate for skating on ice or to a ski. More specifically, the present invention concerns a binding in accordance with the claims.

BACKGROUND OF THE INVENTION

When skating on ice or snow, it is advantageous to have a skate or a ski, below referred to as vehicles, with as long a contact surface against the ice/snow as possible during the gliding phase. The skater/skier hereby becomes less sensitive to imperfections in the underlying surface and to inadequate technique. A short contact surface against the ice/snow provides advantages during quick maneuvers and push-off. Some existing technical solutions and their advantages and disadvantages are described below.

For skating on vehicles with long contact surfaces against the ice/snow, there are currently a number of technical solutions based on a so-called "clap" functionality, herein used for a ski or a skate binding were the heel or the shoe can be lifted from the vehicle or similar solutions, allowing movement between the shoe and the vehicle for a more efficient push-off. For these types of bindings the point of attachment is placed in front of the shoe or under the front part of the shoe. When the skater/skier pushes off, the heel area of the shoe releases its contact with the vehicle. This improves the power of the push-off compared to if the entire shoe is fixed to the vehicle. The push-off is however limited by the fact that the attachment point is more or less fixed. Due to the length of the vehicle's contact surface against the ice/snow, the skater/skier is forced to perform a substantial ankle movement to push-off. In order to allow this movement the skater/skier must use a shoe that is relatively soft. This leads to the support around the foot not being optimal, which affects the push-off negatively.

Bandy players play on large ice surfaces and bandy skates therefore also have a vehicle with a long contact surface against the ice. However, they are not helped by a clap functionality since they also must be able to handle quick turns. Because of the long contact surface against the ice, bandy players must be able to accomplish substantial ankle movements to achieve good push-offs. This means that the skater is forced to use a low shoe that does not provide optimal support.

Skating on vehicles with a short contact surface against the ice such as an ice hockey skate, allows for advantages in the push-off. The skater can "roll" forward on the blade and thereby achieve a longer contact time combined with application of high force against the ice, thereby achieving greater force during the push-off. Rolling forward on the blade means that the skater does not have to perform as much of a movement in the ankle, thus allowing the use of a stiffer shoe. A stiffer shoe gives more support and allows for a more powerful push-off. The short contact surface against the ice also provides for better maneuverability during sharp turns. However, a disadvantage with the short contact surface is that it glides less efficiently. This is brought about by the skater being more affected by unnecessary movements and unevenness in the underlying surface than if he would have been skating on a vehicle with a long contact surface against the ice.

A known type of binding for skates that builds upon the clap functionality is disclosed in the American patent U.S. Pat. No. 6,152,458, which shows a binding in which the shoe is attached to the upper chassis section and the skate is attached to the lower chassis section. The upper chassis section is arranged for pivotal movement around an axis, whereby the upper chassis section is arranged to be pivotal relative to the lower chassis section in the skate's longitudinal extension. The binding further allows for both the heel area and toe area of the shoe being movable during push-off when using the skate. The known binding thus shows an upper and a lower chassis interconnecting at two points. When pushing-off, the heel may be lifted at the same time as the toe area is moved backward upward. The design allows for a long push-off. However, with the known binding the skater is not able to shift the center of gravity along the length of the foot with an even pressure.

Another known type of binding for a skate that builds upon the clap functionality is disclosed in the Dutch patent application NL 8702068 A, which shows a binding in which the shoe is attached to the upper chassis section and the skate is attached to the lower chassis section. The known binding is designed to lift the heel portion of the shoe from the rear portion of the skate during push off. The coupling means has a substantial supporting function of the upper chassis in the first phase of the push off and the upper and lower contact surfaces are not in contact with each other during the whole phase of the push of, see FIG. 4 of NL 8702068. With the known binding the skater is not able to shift the center of gravity along the length of the foot with an even pressure.

SUMMARY OF THE INVENTION

It is an object of the present invention to improve the ability for ice skaters and skiers to shift the center of gravity along the length of the foot, from heel to toe, with an even pressure, to improve skating/skiing comfort and performance.

This object is achieved by a binding for a vehicle according to the present invention as defined in claim 1.

Thus, in accordance with an aspect of the present invention, there is provided a binding for a vehicle, such as a skate for skating on ice or a ski, including an upper chassis section, a lower chassis section, and a coupling means, wherein the upper chassis section and the lower chassis section are engaged by means of the coupling means, and are pivotally arranged relative to each other in the longitudinal direction of the vehicle. The binding further includes a first contact surface and a second contact surface, wherein at least one of the first contact surface and the second contact surface is curved. The first contact surface and the second contact surface are arranged such that, during pivoting of said upper chassis section and said lower chassis section relative to each other, at least a portion of said first contact surface is in contact with at least a portion of said second contact surface.

The present binding provides a stepless rolling motion between the upper and the lower chassis, which provides a good ability for ice skaters and skiers to shift the center of gravity along the length of the foot, from heel to toe, with an even pressure. The rolling motion enables users to use a stiffer shoe and/or a shoe with higher shaft for more support of the foot and leg, facilitating a more powerful push off. The stepless rolling motion alone, however, also facilitates a more powerful push off since the ability to shift the center of gravity along the length of the foot with even pressure is a more natural movement than the movement existing technologies within the area provides. The rolling motion also enables the skater to push off with a larger angle that is more beneficial and allows for use of large muscle groups during a larger part of the push off.

The skater's/skier's balance is improved since the rolling motion makes it easier to parry/compensate unevennesses in the underlying surface, i.e. ice or snow. The invention further enables a vehicle with a prolonged, and flatter, contact surface against the ice/snow, compared to normal, thereby providing better glide, at the same time as it allows for the skater to quickly shift the weight from heel to toe, thus enabling for quicker, shorter turns and directional changes.

For the purposes of this application, the term "curved" is to be understood as at least a portion of the contact surface being provided with a curvature.

In accordance with embodiments of the binding, the coupling means comprises different combinations of elements, which advantageously provide both an interconnecting function and a spring back function.

In accordance with an embodiment of the binding, it is arranged to be mounted on top of or below a clap binding. Typically, for mounting on top of the clap binding, the binding of this invention has ordinary connection means currently provided on shoes. For mounting below a clap binding, the binding of this invention has ordinary connection means currently provided on vehicles having clap bindings mounted thereon. By the term "clap binding" is meant a binding that allows the user to lift the heel part of the shoe from the vehicle. This is preferable for skaters/skiers that, for example, needs a "release" of the heel from the skate/ski during the last phase of the push off. For users needing a release of the heel from the skate/ski, an initial detention or resistance is required in order to transfer the power from the foot to the vehicle in an optimal way before the heel is released. This resistance can e.g. not be included with the binding disclosed in NL8702068, since the ability to lift the heel properly would simultaneously disappear. The binding according to the present invention combined with a clap binding, solves this through making the ability to lift the heel separate from the rolling motion. This way springs or similar elements can be mounted so that a resistance is acquired in the initial rolling motion. The ability to lift the heel is then accomplished by mounting a clap binding under or on top of the present invention.

In accordance with an embodiment of the binding, the first and/or the second contact surface is arranged to be interchangeable. This enables the user to easily adjust the range of movement between the upper and the lower chassis.

In accordance with an embodiment of the binding, at least one interchangeable contact surface includes a separate front and a separate rear portion. This enables the user to combine different curvatures.

In accordance with an embodiment of the binding, at least one of the first or the second interchangeable element is arranged to be movable in the longitudinal direction of the binding. This enables the user to easily adjust where the curvature is arranged under the foot.

In accordance with further embodiments of the binding certain details of the bindings are interchanged in order to show other ways of reaching the same effect.

These and other aspects, features, and advantages of the invention will be apparent from and further described with reference to the embodiments described hereinafter.

BRIEF DESCRIPTION OF THE DRAWINGS

The invention will be described in more detail below, with reference to the included schematic drawings that show examples of the currently preferred embodiments of the invention.

DETAILED DESCRIPTION OF EMBODIMENTS

Figure 1:
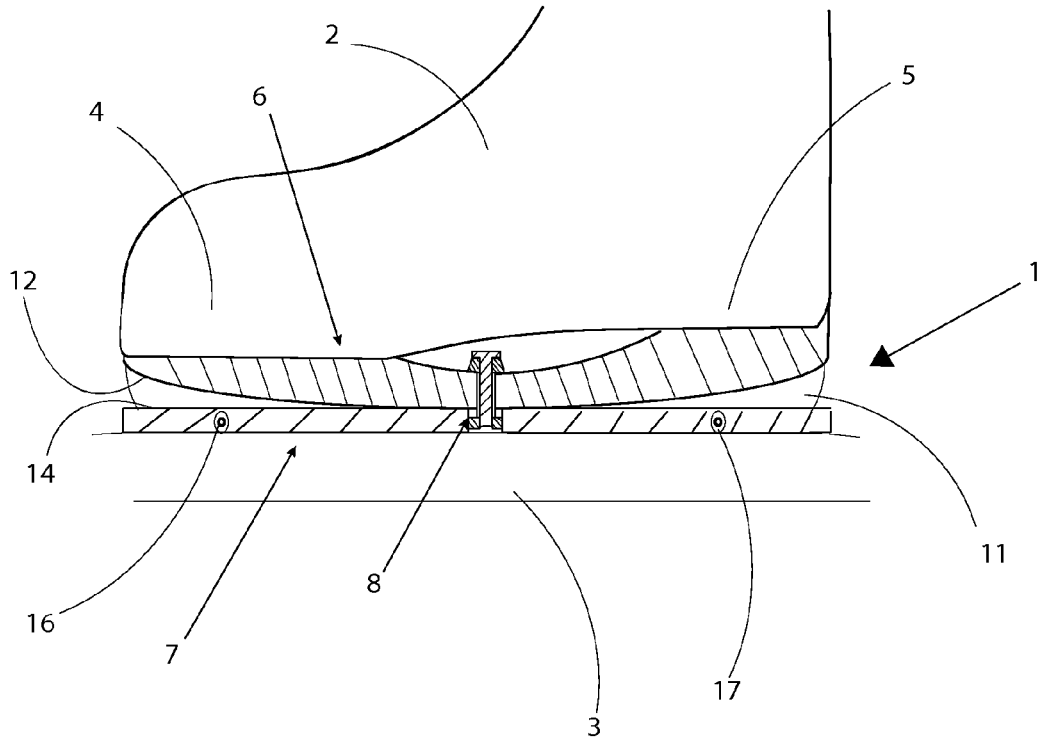
FIG. 1 shows an embodiment of a binding in accordance with the present invention.

With reference to FIG. 1, an embodiment of a binding 1 in accordance with the present invention is shown. The binding 1 is arranged to connect a shoe 2 to a skate for skating on ice or to a ski, hereafter referred to as the vehicle 3. For the avoidance of doubt, it should be noted that the skate could either be comprised by a separate blade or a blade integrated in some form of skate chassis. The shoe 2 has a toe area 4 and a heel area 5. The shoe 2 consists of any type of shoe suitable for the purpose. The type of shoe does not limit the scope of protection of the present invention and is therefore not described in more detail in this patent application. The vehicle 3 is comprised of a type of vehicle suitable for the purpose. The type of vehicle is not limiting for the scope of protection of the present invention, and is therefore not described in more detail in this patent application. The binding 1 includes at least one chassis including at least one upper chassis section 6 and at least one lower chassis section 7. The upper chassis section 6 is preferably connected to the shoe 2. The lower chassis section 7 is preferably connected to the vehicle 3. The upper chassis section 6 and the lower chassis section 7 are connected to each other via coupling means 8. The coupling means 8 in FIG. 1 is only one possible embodiment of a coupling means used for the present invention. The coupling means 8 allows for the upper chassis section 6 and the lower chassis section 7 to be rotated both backwards and forwards relative to each other in the longitudinal direction of the vehicle 3. In alternative embodiments, the upper chassis section 6 is integrated in the shoe 2. In alternative embodiments, the lower chassis section 7 is integrated in the vehicle 3.

The coupling means 8 can be embodied in different ways but always has both a coupling and a spring back functionality. This is achieved either through one or several elements, each of which, individually or in combination, has either one or both effects. The elements can be placed together or separately. Non-exhaustive examples of elements include axles, screws, bolts, springs, straps and bushings. Regardless of embodiment, the parts that enable these effects are comprised in the "coupling means". The embodiments shown in the drawings are only possible embodiments of coupling means and are not limiting for the scope of the present invention.

Figure 2A:
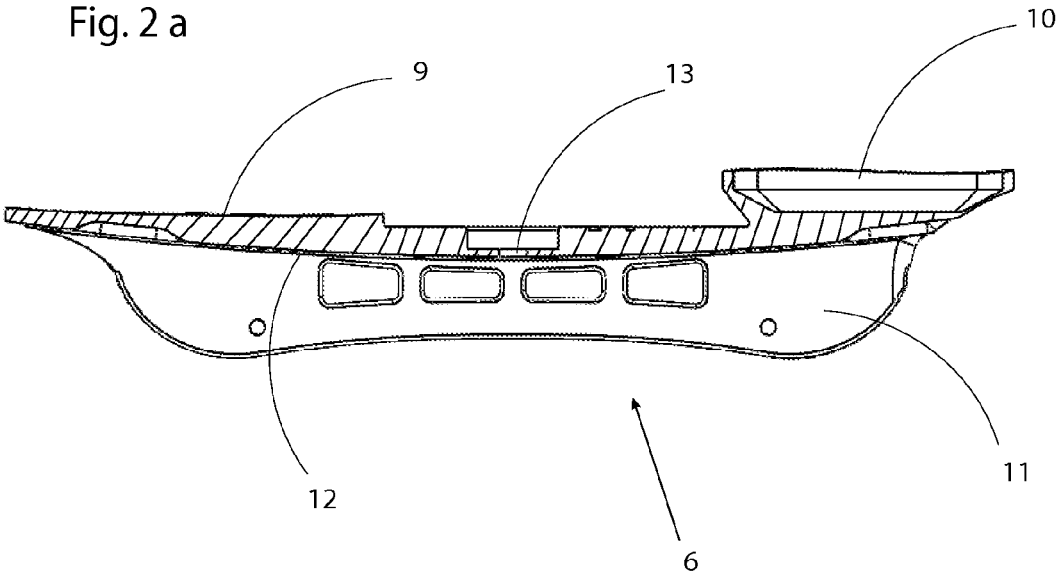
FIGS. 2A-B show an upper chassis section included in the binding in more detail.
Figure 2B:
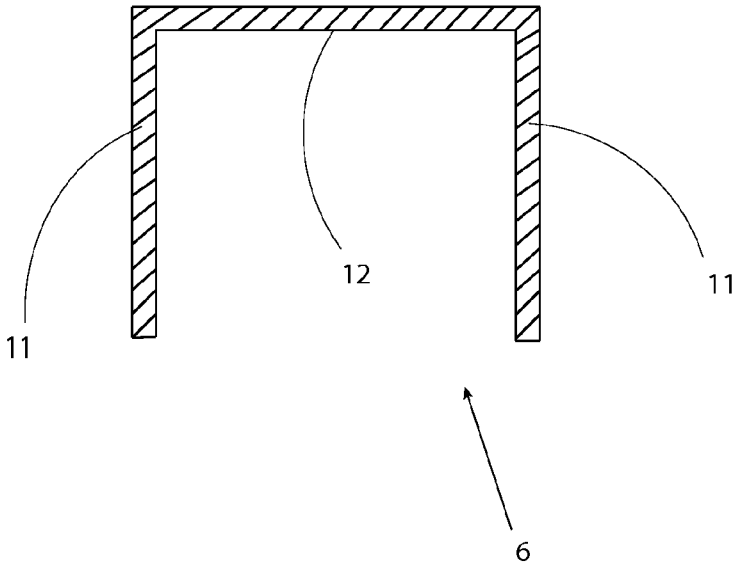

FIG. 2 shows a preferred embodiment of the upper chassis section 6. The shown embodiment is only one possible embodiment of the upper chassis section 6 and is not limiting for the scope of protection of the present invention. The upper chassis section 6 preferably includes a front attachment portion 9 and a rear attachment portion 10, together allowing for attachment to the shoe 2. In alternative embodiments the front attachment portion 9 and the rear attachment portion 10 are integrated and form one attachment portion, such as for example an attachment plate (not shown). The front attachment portion 9 is intended to be connected to the toe area 4 of the shoe 2. The rear attachment portion 10 is intended to be connected to the heel area 5 of the shoe 2. The upper chassis section 6 in the exemplifying embodiment includes two essentially vertical portions 11, which run along each outer side of the lower chassis section 7. Alternatively, the vertical portions 11 may have another direction and form suitable for the purpose. The vertical portions 11 may in alternative embodiments run along at least one track in the lower chassis section 7 (not shown). The technical effect of the vertical portions 11 is that they increase the torsional rigidity and control the relative movement between the lower chassis section 7 and the upper chassis section 6. In this embodiment of the upper chassis section 6, at least one first contact surface 12 is arranged longitudinally at the bottom, between the vertical portions 11. In a preferred embodiment the first contact surface 12 is curvilinear. In alternative embodiments the first contact surface 12 consists of another, for the purpose suitable, arc-shaped surface. The upper chassis section 6 is in the vertical direction provided with at least one through hole 13.

In alternative embodiments, the upper chassis section 6 is provided without the vertical portions 11. In alternative embodiments, the upper chassis section 6 is provided with only one vertical portion 11 or alternatively with more than two vertical portions. In order to make the binding 1 lighter, it may be provided with perforations, holes or similar solutions in the vertical portions 11. The attachment parts 9 and 10 of the upper chassis sections 6 can be equipped with holes, a clip function or other suitable device that facilitates the attachment to a shoe 2.

Figure 3A:
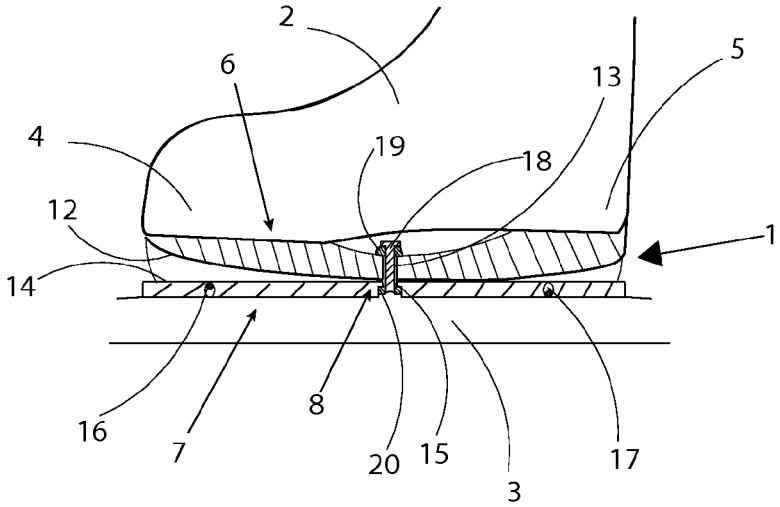
FIGS. 3A-C show an embodiment of the binding during use.
Figure 3B:
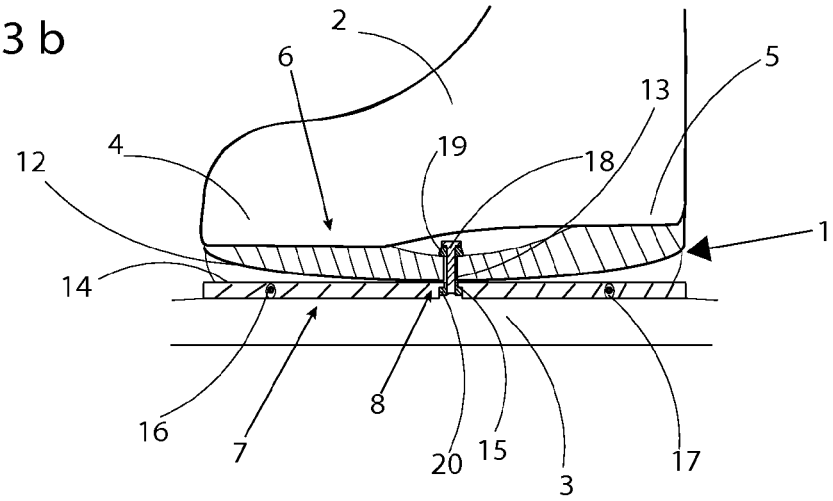
Figure 3C:
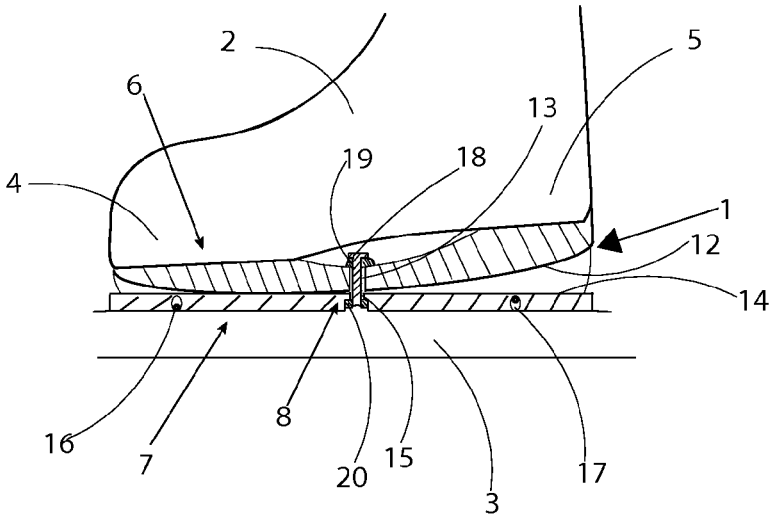

FIGS. 3A-C show a preferred embodiment of a binding 1 according to the invention, which comprises an upper chassis section 6, which is attached to a shoe 2, and a lower chassis section 7, consisting of a rectangular plate, which is attached to a vehicle 3. The upper chassis section 6 and the lower chassis section 7 are connected by a coupling means 8, which comprises an axle 18 and a spring back element 19. The shown embodiment is only one possible embodiment of the lower chassis section and is not limiting for the scope of protection of the present invention. In this embodiment the second contact surface 14 is flat and arranged in the longitudinal direction on top of the lower chassis section 7. In this embodiment the lower chassis section 7 is provided with at least one vertical through hole 15, through which the axle 18 is arranged. The lower chassis section 7 may be provided with holes, clip functions of other suitable devices that facilitate attachment to a vehicle 3. In alternative embodiments, the lower chassis section 7 includes at least one track in the longitudinal direction of the binding 1, in which longitudinal direction at least one vertical part 11 runs (not shown).

In the exemplifying embodiment shown in FIGS. 3A-C, the upper chassis section 6 includes two reinforcing elements 16. In the figures, the reinforcing elements 16 are exemplified by threaded rods. Each threaded rod 16 is preferably attached with screws, or other suitable fasteners in the upper chassis section 6 and runs through a slot 17 in the lower chassis section 7. The technical effect of the reinforcing element 16 is to increase the torsional rigidity of the binding 1. During twisting, i.e. torsion forces, between the upper chassis section 6 and the lower chassis section 7, the reinforcing element 16 runs freely in the slot 17. In alternative embodiments, the binding 1 may be constructed without the reinforcing element 16 and the slot 17 in the lower chassis section 7. The embodiment shown in the drawings is only one possible embodiment of a reinforcing element and is not limiting for the scope of the present invention.

Figure 4A:
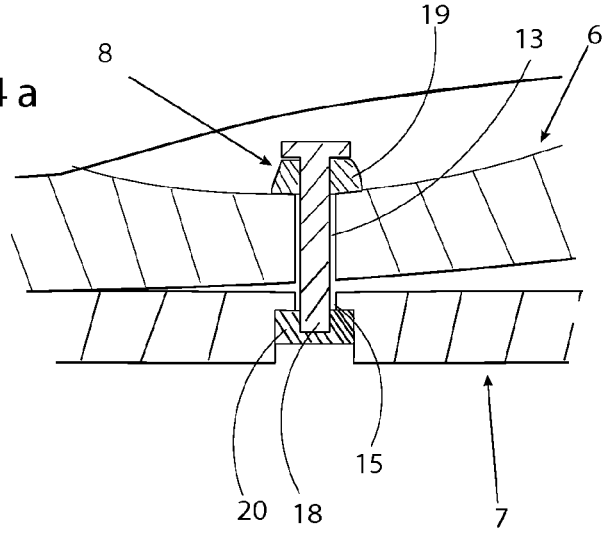
FIGS. 4A-C show a close-up of a coupling means included in an embodiment of the binding according to the present invention.
Figure 4B:
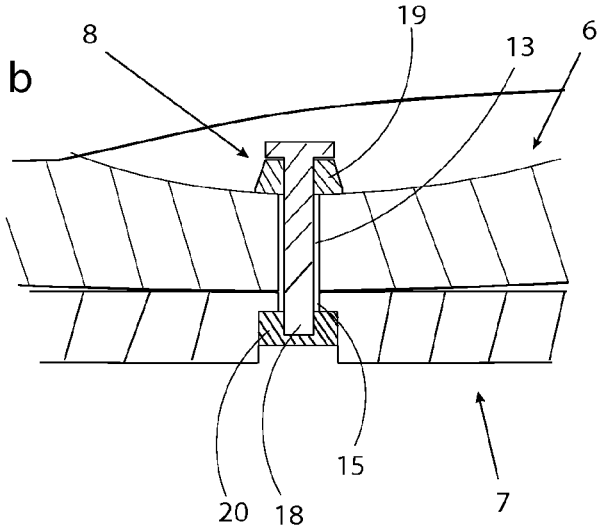
Figure 4C:
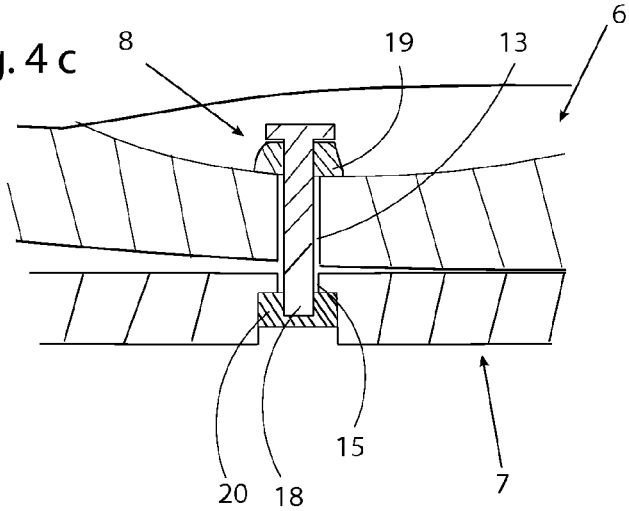

FIGS. 4A-C show an embodiment the coupling means 8 and its functions. In this embodiment the coupling means 8 consists of an axle 18 and a spring back element 19. The axle 18 is arranged in an essentially vertical direction and passes through the hole 15 arranged in the lower chassis section 7 and through the hole 13 arranged in the upper chassis section 6. The axle 18 may consist of a screw, a bolt or another suitable part. In this embodiment, the spring back element 19 is arranged around the axle 18. The spring back element 19 is held together by the axle 18 and at least one nut 20 or other element suitable for the purpose. The spring back element 19 may for example consist of a bushing made of rubber, a rubber-like material or other for the purpose suitable material, or of a spring. The technical function is that the coupling means 8 holds together the upper chassis section 6 and the lower chassis section 7 and provides the spring back effect.

The parts that are explained in detail above, allow for a stepless rolling motion between the upper chassis 6 and the lower chassis 7, allowing the chassis to rock both backwards and forwards in relation to each other, which clearly separates the invention from prior art. The ability of the present binding to rock both backwards and forwards enables the advantages described in the above Summary of the Invention. FIGS. 3A-C show the function of the binding 1 when the parts work together, which is explained in more detail in the following text.

In the embodiments in FIG. 3A-C, the first curved contact surface 12 of the upper chassis section 6 rests against the flat second contact surface 14 of the lower chassis section 7. The coupling means 8 engages the upper chassis section 6 with the lower chassis section 7. Since the coupling means 8 includes a spring back element 19 that is flexible, movement between the upper chassis section 6 and the lower chassis section 7 is possible. When the skater/skier applies pressure to the toe area 4 or the heel area 5 of the shoe 2 during movement of his leg, the curved first contact surface 12 of the upper chassis section 6 and the flat second contact surface 14 of the lower chassis section 7 move relative to each other. Preferably, the curved first contact surface 12 rolls against the flat second contact surface 14. The spring back element 19 is then pressed together, accumulating energy, on the side where the skater/skier applies pressure. When the pressure ceases, the spring back element 19 releases energy and returns to its original shape.

If the axle 18, in the embodiments shown in FIGS. 3A-C, consists of a screw, the spring back element 19 can be compressed by the axle 18 or nut 20 being tightened, whereby the extent of the movement, at a given force, between the lower chassis section 7 and the upper chassis section 6 becomes smaller. If the axle 18 or the nut 20 is instead loosened, the bushing 19 is less compressed and the extent of the movement, at a given force, between the lower chassis section 7 and the upper chassis section 6 increases. Accordingly, depending on how heavily compressed the spring back element 19 is, the movement between the lower chassis section 7 and the upper chassis section 6 at a given force differs.

The stepless movement described above provides advantages for several different types of users. For cross country skiers and ice skaters who use a separate vehicle with a long contact surface against the ice/snow and who attach it to a shoe by way of a binding with one or more fixed points of rotation, the present invention provides advantages compared to existing designs. Since the movement required to accomplish push-off may be achieved by a stepless rolling movement between the upper and lower chassis section, there is no need for extensive movements of either ankle or toe joints. The skier/skater may therefore use a stiffer shoe providing better support for the foot and leg, and thereby excellent transfer of power from the foot to the vehicle during push-off. Further, the stepless rolling motion allows the skier/skater to move his/her center of gravity and thus the pressure against the ice/snow without having to bend his/her knee, foot or toe joints. This allows for a constant pressure through all phases of push-off and thereby allows for a more efficient push-off than existing designs. The kinetic energy that is created when the skater/skier uses the rolling movement to move his/her center of gravity forward also adds to a more powerful push-off. Because the invention enables a coupling technology without a fixed point of rotation, the skater/skier may adjust the angle of their ankle during push-off, depending on their style of skating/skiing and terrain.

There are also skaters who use vehicles, which may be viewed as one unit together with the shoe. When this is the case there is no movement between the vehicle and the shoe at push-off. Among these are those who use a vehicle with a long contact surface against the ice, such as bandy players, and those who use a vehicle with a short contact surface against the ice, such as hockey players. By placing a curved contact surface between the upper and lower chassis sections, thus allowing for movement between the shoe and the vehicle even within the one unit, the invention allows both kind of skaters, to prolong the contact surface against the ice, thereby providing better glide. At the same time the invention also allows both kind of skaters to maintain or improve on the advantages of the short contact surface against the ice, such as making quicker, shorter turns and directional changes.

Figure 5A:
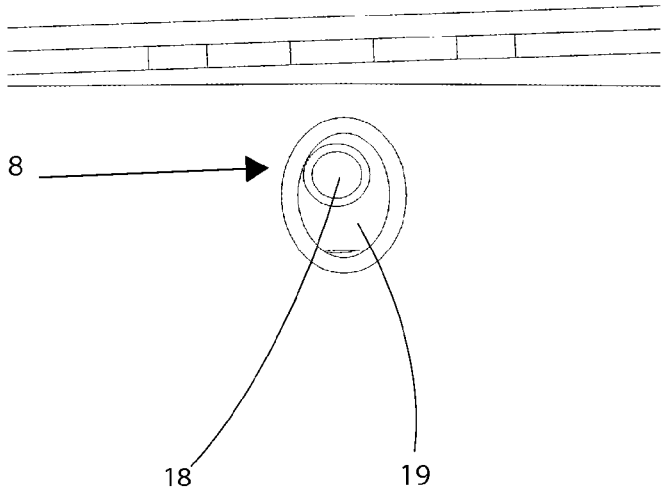
FIGS. 5A-C show a close-up of a coupling means included in an embodiment of the binding according to the present invention.
Figure 5B:
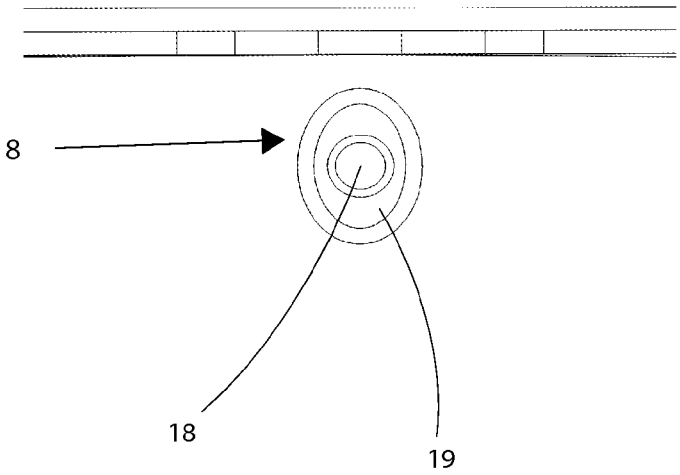
Figure 5C:
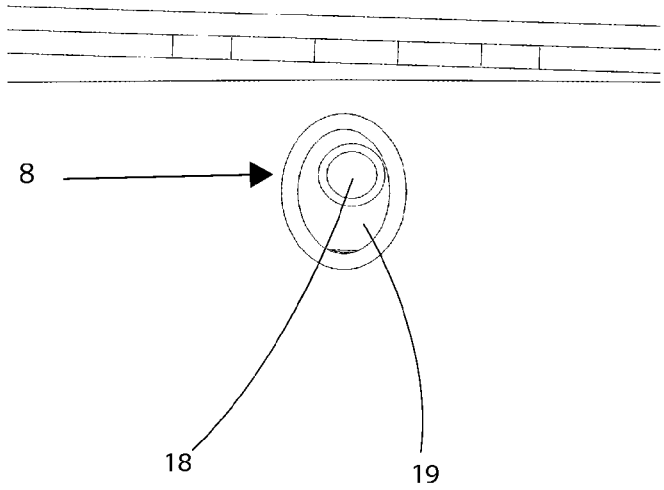

With reference to FIGS. 5A-C, a coupling means 8 according to an alternative embodiment of the binding 1 in accordance with the present invention is shown. In this embodiment the coupling means 8 includes an axle 18 which is arranged in an essentially horizontal direction. Preferably, the axle 18 is attached to the upper chassis section 6 in both ends, e.g. in the vertical portions 11, and runs through a spring back element 19, which is arranged in the lower chassis section 7. In an alternative embodiment the axle 18 is mounted in the lower chassis section and runs through at least one spring back element 19, which is arranged in the upper chassis section 6.

Figure 6:
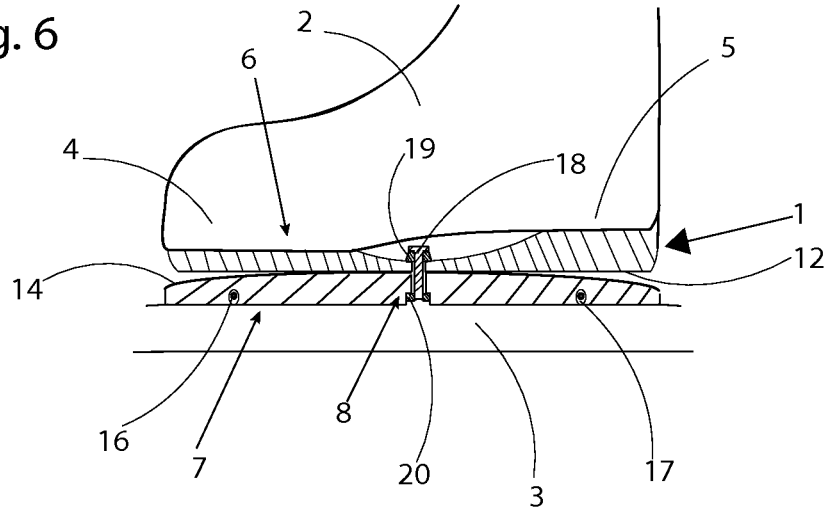
FIG. 6 shows an embodiment of the binding according to the present invention.

With reference to FIG. 6 an alternative embodiment of the binding 1 in accordance with the present invention is shown. In this embodiment the lower chassis section 7 includes a second contact surface 14, which is curved, and the upper chassis section 6 includes a first contact surface 12 which is flat.

Figure 7:
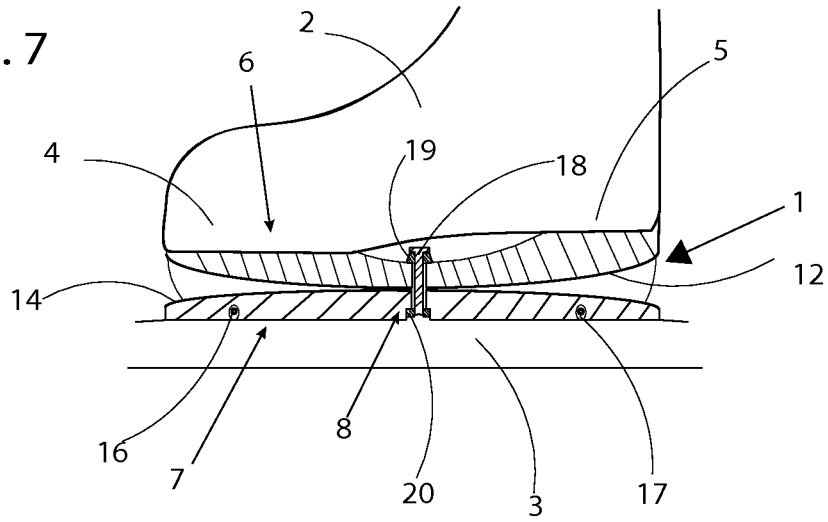
FIG. 7 shows an embodiment of the binding according to the present invention.

With reference to FIG. 7 an alternative embodiment of the binding 1 in accordance with the present invention is shown. In this embodiment, both the first contact surface 12 and the second contact surface 14 are curved.

Figure 8:
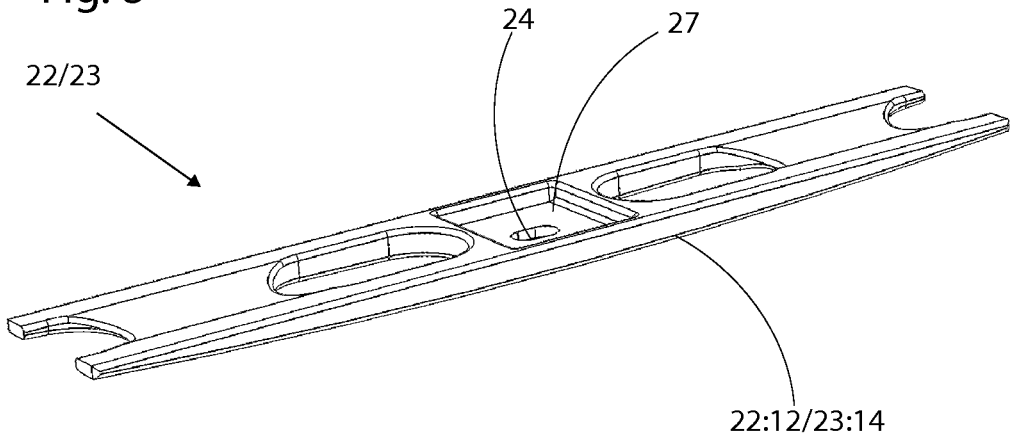
FIG. 8 is a perspective view of an interchangeable element included in an embodiment of the binding according to the present invention.

According to an embodiment of the binding 1, at least one of the first contact surface 12 and the second contact surface 14 is interchangeable by being arranged on a separate element. FIG. 8 shows an interchangeable element according to one embodiment of the binding 1. The interchangeable element 22 may be arranged to lay with one side flush against, or attached to, the upper chassis section 6 thereby forming part of the upper chassis section 6 while its opposite side, the side that is free includes a surface for resting against the lower chassis section 7. Alternatively, the interchangeable element 23 may be arranged to lay with one side flush against, or attached to, the lower chassis section 7 thereby forming part of the lower chassis section 7 while its opposite side, the side that is free, includes a surface for resting against the upper chassis section 6. The separate interchangeable element 22 then includes the first contact surface 12, note that the first contact surface is designated 22:12 in FIG. 8, and the second separate interchangeable element 23 includes the second contact surface 14, note that the second contact surface is designated 23:14 in FIG. 8. The interchangeable elements 22 or 23 in the shown embodiment include a through hole 24 in which a coupling means 8 can be placed. The technical effect of using an interchangeable element is that the user can easily adjust the range of the movement between the lower chassis section 7 and the upper chassis section 6. By replacing at least one of the separate interchangeable elements 22 and/or 23 with an interchangeable element that has a contact surface(s) with a larger radius than the contact surface(s) that are exchanged, the range of movement between the lower chassis section 7 and the upper chassis section 6 is decreased. By replacing at least one of the separate interchangeable elements 22 and/or 23 with an interchangeable element that has a contact surface(s) with a smaller radius, than the contact surface(s) that are exchanged, the range of movement between the lower chassis section 7 and the upper chassis section 6 is instead increased. Preferably, the separate interchangeable elements 22 and/or 23 lie loose without fastening devices. They are then held in place by the compressive force that the coupling means 8 exercises against the upper chassis section 6 and the lower chassis section 7.

Figure 9A:
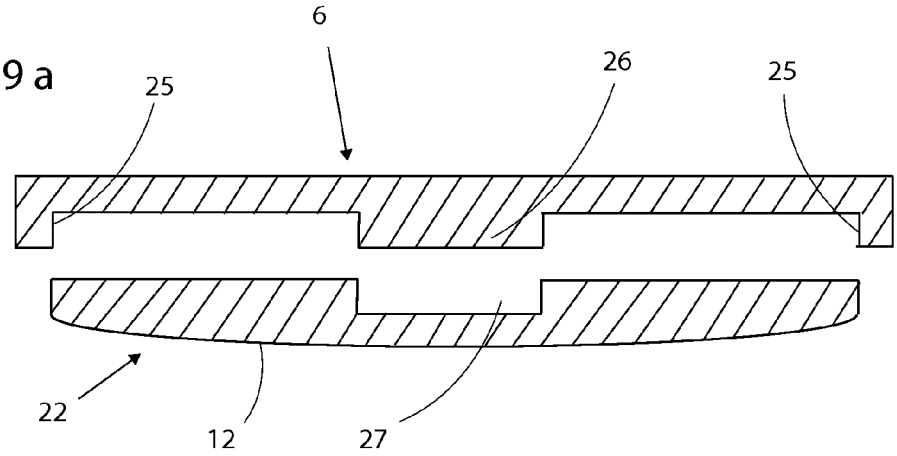
FIGS. 9A-B show a cross sectional longitudinal side view of upper and lower chassis sections included in an embodiment of the binding according to the present invention.
Figure 9B:
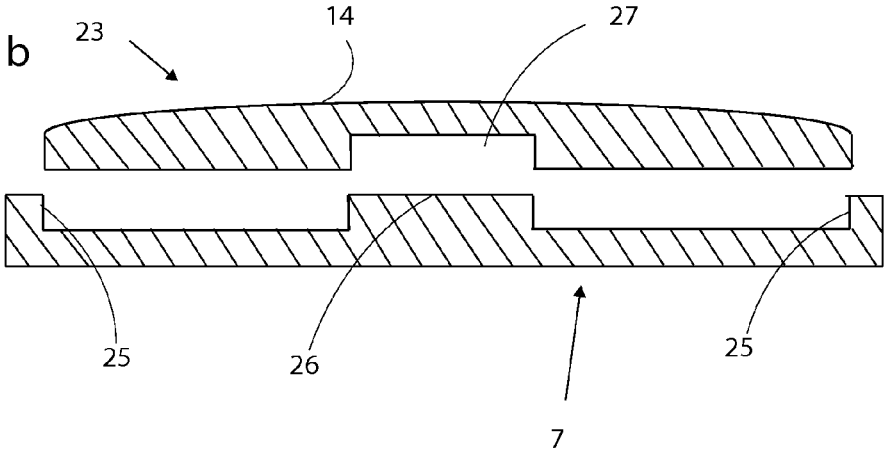

FIGS. 9A-B are schematic cross sectional side views of a preferred embodiment of the binding 1 in which the upper chassis section 6 and/or the lower chassis section 7 preferably includes at least one support section (heel) 25 on each of its front and rear areas. The technical function of the support section is that it prevents the separate interchangeable element 22 and/or 23 from moving in the binding's 1 longitudinal direction. FIGS. 9A-B also show how the upper chassis section 6 and/or the lower chassis section 7 is arranged with a protruding part 26 and how the interchangeable elements 22 and/or 23 are arranged with corresponding receiving parts 27 for holding the separate interchangeable element 22 and/or 23 in place. Alternatively, the separate interchangeable elements 22 and/or 23 may be attached to the upper chassis section 6 or the lower chassis section 7 by, for example being screwed, glued or attached with a quick fastener such as a clip.

Figure 10A:
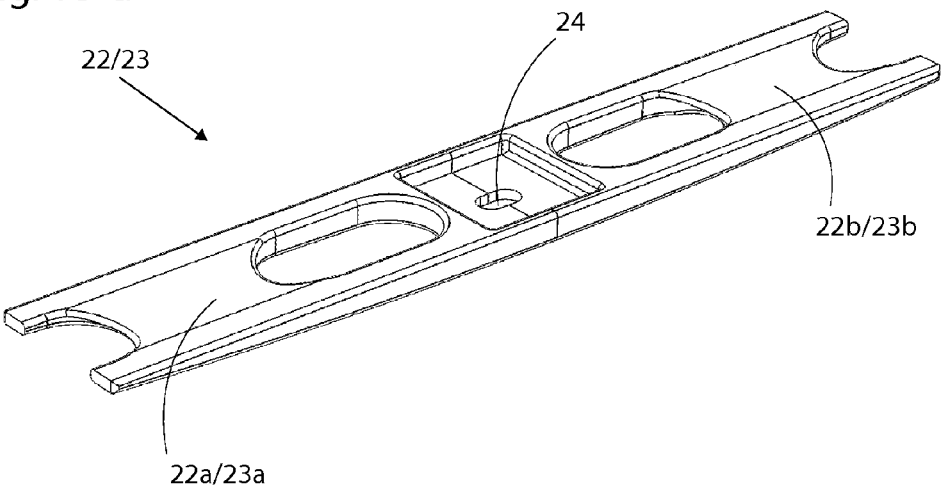
FIGS. 10A-B are perspective views of an interchangeable element included in an embodiment of the binding according to the present invention.
Figure 10B:
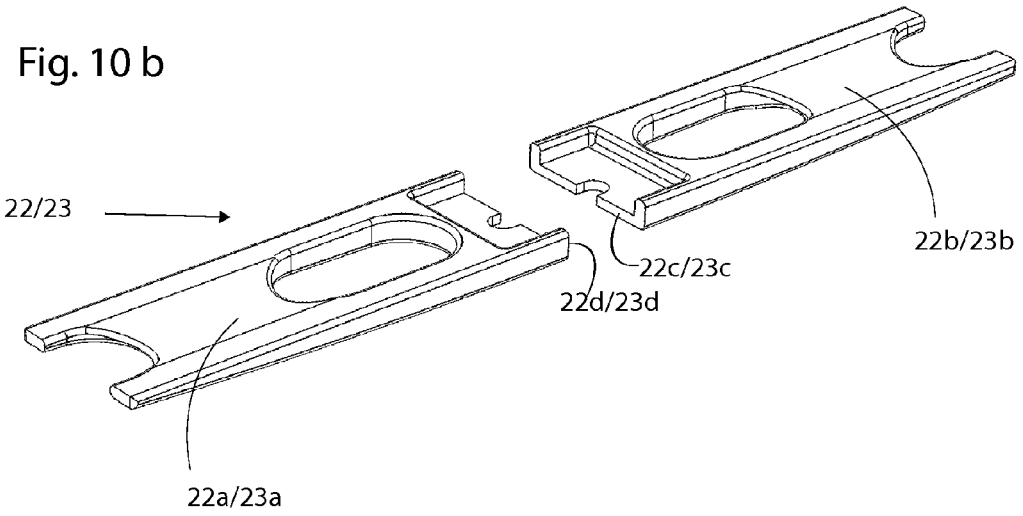

In alternative embodiments, at least one of the separate interchangeable elements 22 and/or 23 is separable. The separate interchangeable elements 22 and/or 23 are then preferably separable in the vehicle's transverse direction. FIGS. 10A-B show one embodiment of the separable separate interchangeable elements 22 and/or 23. The interchangeable element 22 and/or 23 then includes a front portion 22*a* and/or 23*a* and a rear portion 22*b* and/or 23*b*. The technical effect of this is that it becomes easier to replace the separate interchangeable element 22 and/or 23, when the coupling means 8 does not need to be removed in order to be placed in the hole 24 of the interchangeable element 22 and/or 23. The front portion 22*a* and/or 23*a* and the rear portion 22*b* and/or 23*b* may be mounted in the right place from the opposite (from the front portion and the back portion of the binding 1). The front portion 22*a* and/or 23*a* and the rear portion 22*b* and/or 23*b* may be held in place by suitable fixating elements such as clips, screws, or projecting and receiving elements arranged in surfaces 22*c*, 22*d*, 23*c* and 23*d* (not shown).

Figure 11:
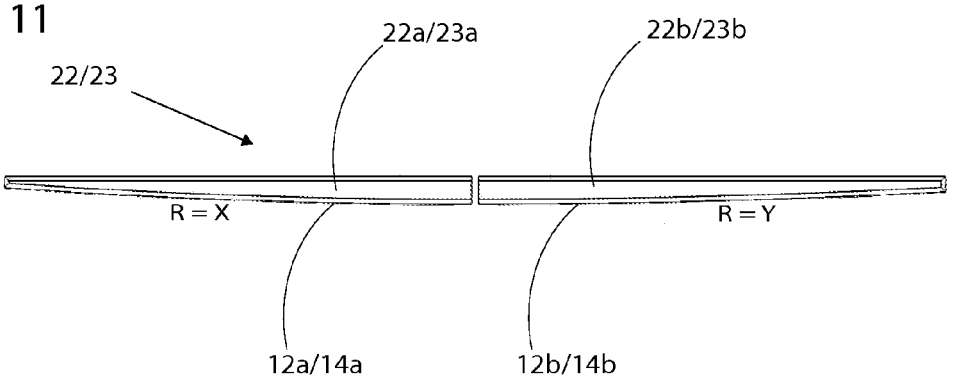
FIG. 11 shows a cross sectional side view of an interchangeable element included in an embodiment of the binding according to the present invention.

By dividing the separate interchangeable element that includes the first contact surface or the second contact surface into two parts, a front and a rear portion, the radius R and/or the shape of the curvature along the first and/or the second contact surface may be adapted to the skater's/skier's own choices, by combining the front and rear portions with different radii or curvature. FIG. 11 shows an embodiment of a separate interchangeable element 22 or 23 where the front portion 22*a* or 23*a* includes one first part of a first/second contact surface 12*a*/14*a* which has radius X, and where the rear portion 22*b* or 23*b* includes one second part of a first/second contact surface 12*b*/14*b* which has radius Y.

In alternative embodiments at least one of the separate interchangeable elements 22 and/or 23 is movable (not shown). The first separate interchangeable element 22 is then preferably movable relative to the upper chassis section 6 and the second separate interchangeable element 23 is then preferably movable relative to the lower chassis section 7. The first separate interchangeable element 22 and/or the second separate interchangeable element 23 are preferably movable in the longitudinal direction of the vehicle 3. The technical effect of this is that the skater/skier may decide where the curvature is located under their foot. This is important in order to be able to adjust the binding 1 according to the skier's/skater's personal skating style. In one alternative embodiment, the entire lower chassis section 7 is movable relative to the upper chassis section 6 (not shown). Preferably, it is movable in the longitudinal direction of the vehicle 3.

In alternative embodiments, the coupling means 8 is movable relative to the upper chassis section 6 or to the lower chassis section 7 (not shown). Preferably, the coupling means 8 is movable in a longitudinal direction of the binding 1.

Figure 12:
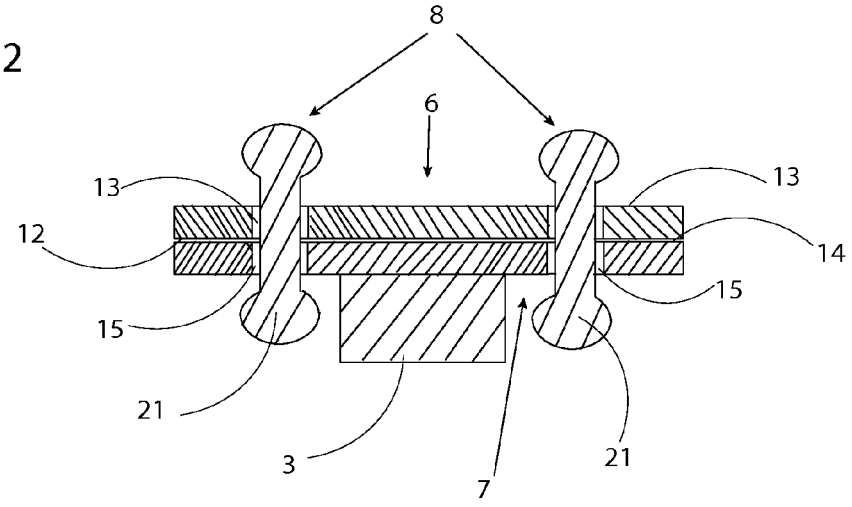
FIG. 12 is a cross-sectional view of an embodiment of the binding according to the present invention.

FIG. 12 shows an alternative embodiment in which, the coupling means 8 includes two rubber straps 21, or other for the purpose suitable elements with elastic function, essentially arranged in the bindings 1 vertical direction. In alternative embodiments, the number of elastic elements may be one, or more than two.

In alternative embodiments the coupling means 8 comprises at least one rubber strap 21 or other for the purpose suitable element with an elastic function, essentially arranged in the horizontal direction.

Figure 13:
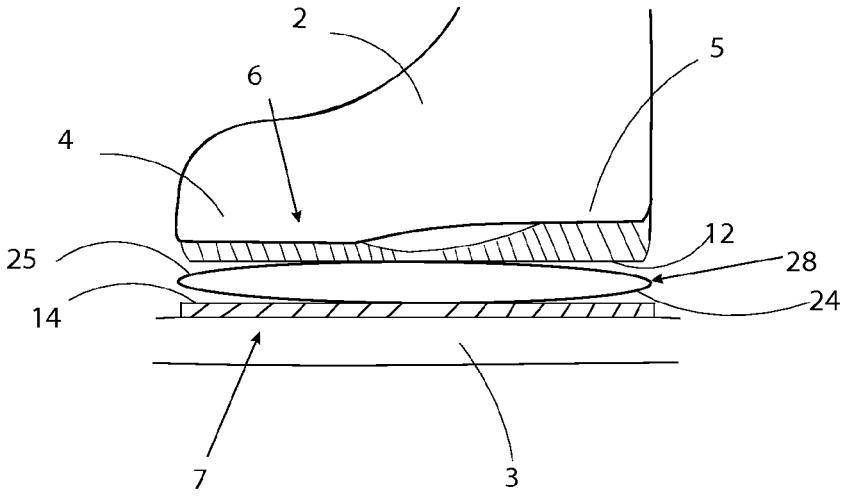
FIG. 13 shows a side view of an embodiment of the binding according to the present invention.
Figure 14A:
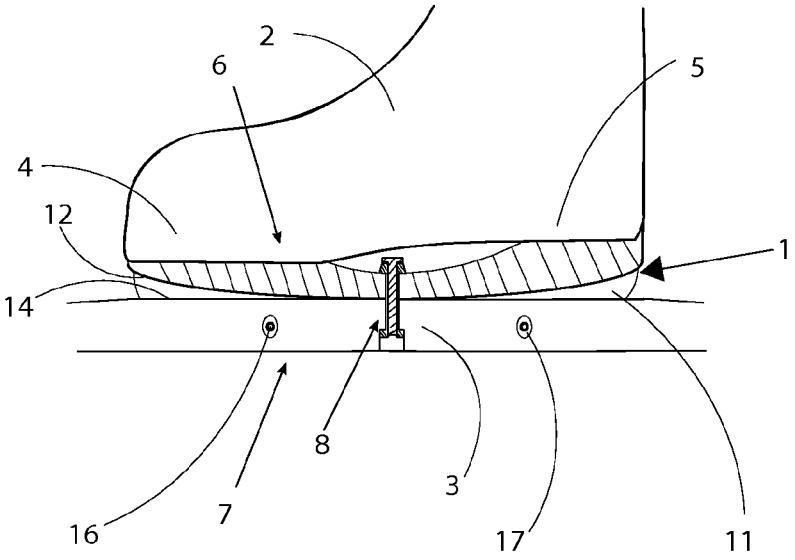
FIG. 14A is a cross sectional side view of an embodiment of the binding according to the present invention, and B-D are cross-sectional views of alternative designs of this embodiment.
Figure 14B:
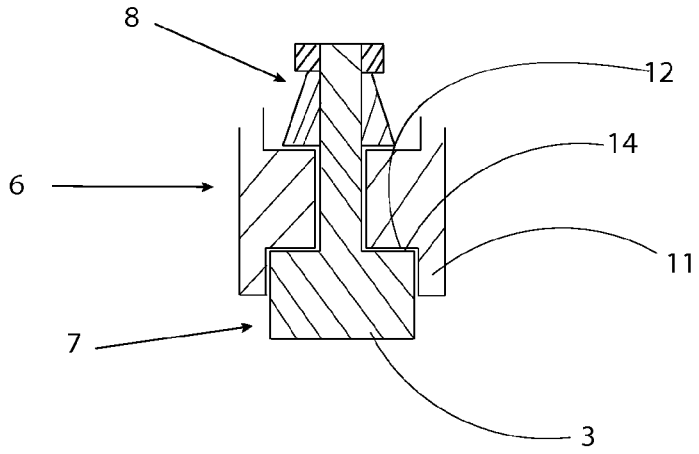
Figure 14C:
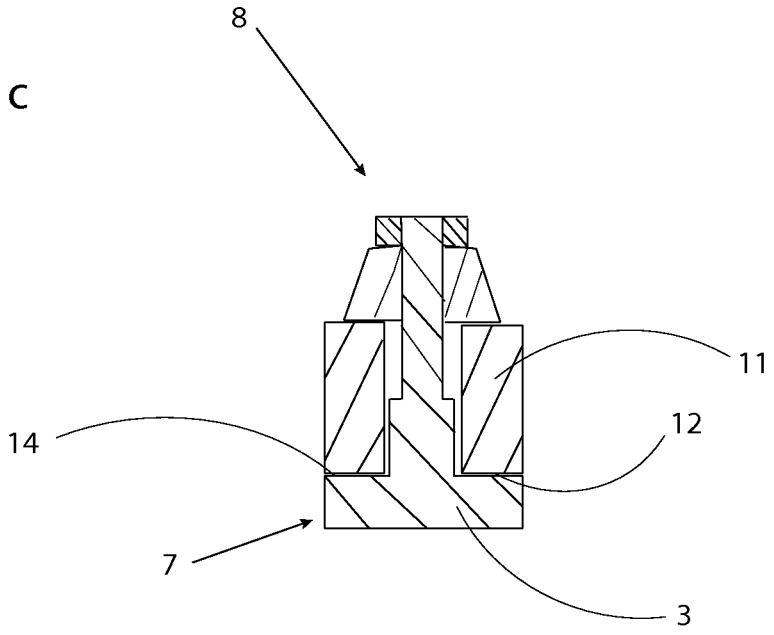
Figure 14D:
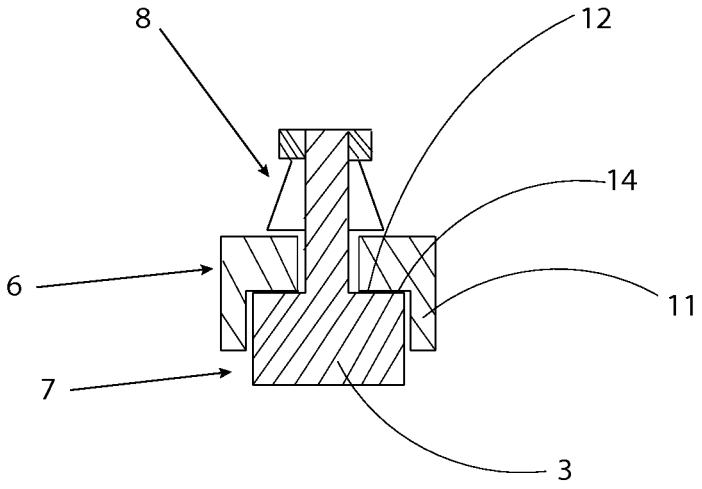

With reference to FIG. 13 an alternative embodiment of a binding in accordance with the invention is shown. In the alternative embodiment, the binding 1 includes a separate intermediate element 28 arranged between the upper chassis section 6 and the lower chassis section 7. The separate intermediate element 28 includes an upper 24 and a lower contact surface 25. At least one of the upper and lower contact surfaces 24, 25 is curved. The upper contact surface 24 constitutes a further second contact surface, at least a portion of which is in contact with at least a portion of the first contact surface 12 included in the upper chassis section 6 during pivoting of the upper chassis section 6 and the lower chassis section 7 relative to each other. The lower contact surface 25 constitutes a further first contact surface, at least a portion of which is in contact with at least a portion of the second contact surface 14 included in the lower chassis section 7 during pivoting of the upper chassis section 6 and the lower chassis section 7 relative to each other.

With reference to FIGS. 14A-D alternative embodiments of a binding in accordance with the invention are shown. In the alternative embodiments the lower chassis section 7 consists of the vehicle 3. According to an alternative embodiment of the binding 1, the axle 18 is integrated with the lower chassis section 7 or the upper chassis section 6, see FIGS. 14A-D.

Figure 15A:
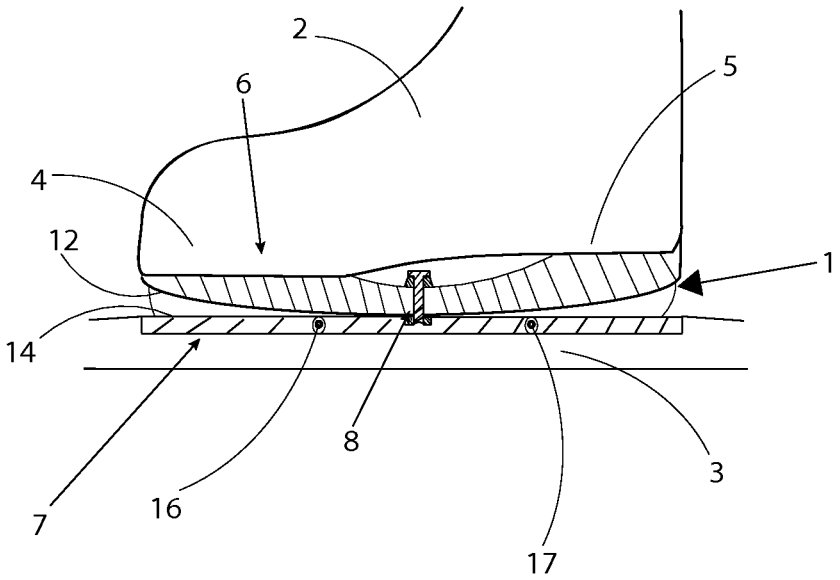
FIG. 15A is a cross sectional side view of an embodiment of the binding according to the present invention, and B is a cross-sectional view according to one design of this embodiment.
Figure 15B:
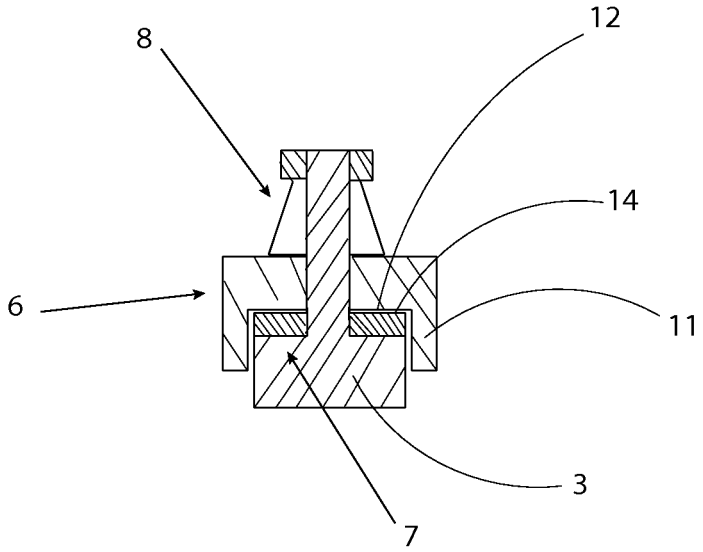

With reference to FIGS. 15A-B alternative embodiments of a binding in accordance with the invention are shown. In the alternative embodiments the lower chassis 7 is integrated in the vehicle 3. Integrating the lower chassis 7 in the vehicle 3 is beneficial for example in lowering the total height of the binding 1.

Figure 16A:
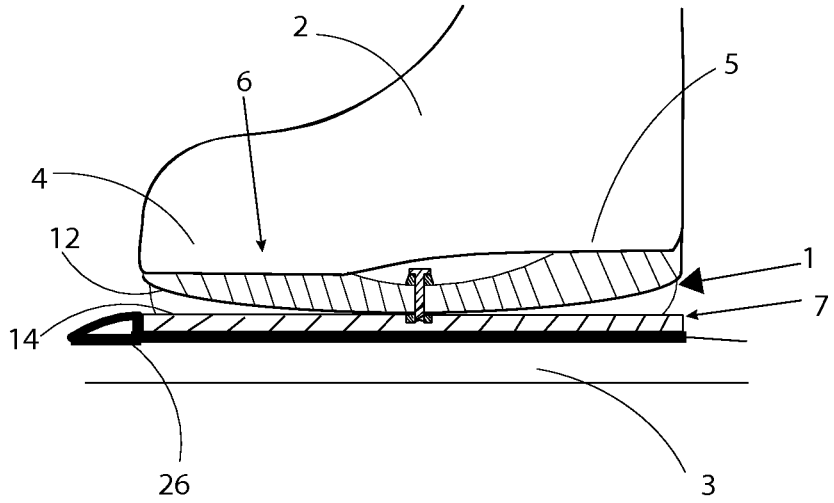
FIGS. 16A-B are cross-sectional side views of embodiments of the binding according to the present invention.
Figure 16B:
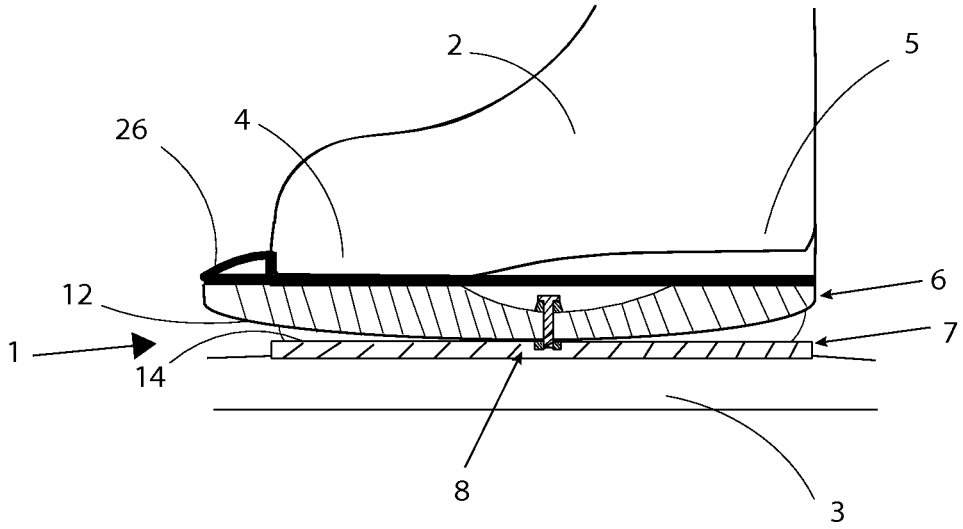

With reference to FIGS. 16A-B alternative embodiments of a binding in accordance with the invention are shown. In the alternative embodiment 16A, the binding 1 is mounted on top of a clap binding 26. In the alternative embodiment 16B, the binding 1 has a clap binding 26 mounted on top.

Figure 17:
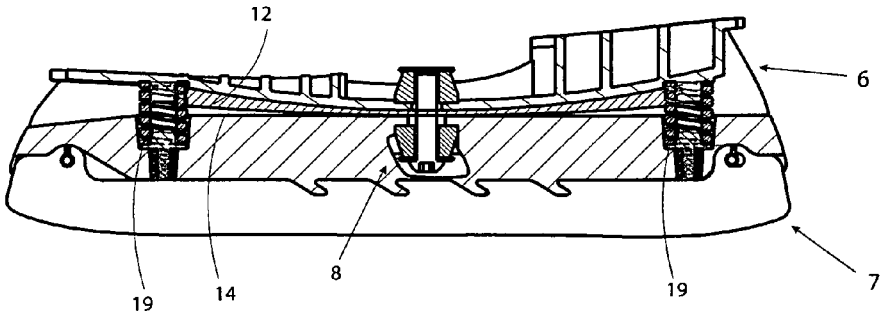
FIG. 17 is a cross-sectional side view of an embodiment of the binding according to the present invention.
Figure 18:
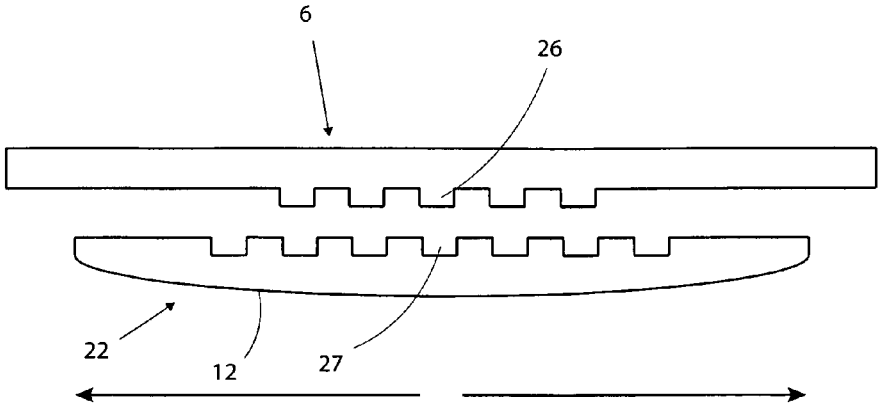
FIG. 18 is a cross-sectional side view of an embodiment of the binding according to the present invention illustrating longitudinal movement of an interchangeable contact surface in relation to the upper chassis section.

With reference to FIG. 17 an alternative embodiment of a binding in accordance with the invention is shown. In the alternative embodiment, the bindings 1 coupling means 8 includes at least one spring back element 19 that is separated from the axle 18 or the rubber strap 21. By separating a spring back element 19, placing it at the rear and/or in the front of the binding 1, the leverage gets smaller, thus demanding more pressure to compress. This makes it easier for the skater to control the movement and increases the power transfer from the foot to the vehicle.

According to an alternative embodiment of the binding 1, the coupling means 8 includes an externally threaded axle, whereby at least one of the lower chassis section 7 and the upper chassis section 6 includes an internally threaded receiving slot for attachment of the coupling means 8.

According to an alternative embodiment of the binding 1, the spring back element 19, forming part of the coupling means 8, is integrated in the upper chassis section 6 or the lower chassis section 7.

According to an alternative embodiment of the binding 1, the spring back element 19, forming part of the coupling means 8, consists of at least one spring or at least one other for the purpose suitable element with a spring back effect.

According to an alternative embodiment of the binding 1, the coupling means 8 is made without the spring back element 19, whereby the movement between the upper chassis section 6 and the lower chassis section 7 is determined by a space between the coupling means 8 and the chassis sections, and/or the choice of material for the chassis sections and the coupling means 8.

According to an alternative embodiment of the binding, the upper chassis section 6 is integrated in a shoe 2.

According to an alternative embodiment of the binding 1, the vertical parts 11 are arranged on the lower chassis section 7 and the upper chassis section 6 can include at least one track.

According to an alternative embodiment of the binding 1, the coupling means is arranged so that the upper chassis section 6 and the lower chassis section 7 may easily be disassembled and then later reassembled, by means of the coupling means 8 including a snap lock or other suitable locking device. This is advantageous for example during the mounting and replacement of interchangeable elements, or for other purposes.

Even if certain preferred embodiments have been described in detail, variations and modifications within the scope of the invention may become apparent for specialists in the field and all such details, variations and modifications are regarded as being within the scope of the following claims.

In the detailed description of the present invention, design details may have been omitted which are apparent to persons skilled in the art. Such obvious design details are included to the extent necessary so that the proper and full performance of the present invention is achieved. For example, elements such as washers, screws or rivets are included to the extent necessary so that an adequate function is obtained.

It is to be noted, that for the purposes of this application, and in particular with regard to the appended claims, the words "including" and "comprising" do not exclude other elements, that the word "a" or "an", does not exclude a plurality, which per se will be apparent to a person skilled in the art. For instance, referring to claim 1, the binding can have more than one first contact surface, and more than one second contact surface, as has been described above as well.

The invention claimed is:

1. A binding for a vehicle, such as a skate for skating on ice or a ski, comprising:
- an upper chassis section;
- a lower chassis section; and
- a coupler,
- wherein the upper chassis section and the lower chassis section are engaged via the coupler, and are pivotally arranged relative to each other in the longitudinal direction of the vehicle,
- wherein the upper chassis section is pivotable at least in a backwards direction in relation to a neutral position of the upper chassis section and the lower chassis section,
- wherein the binding further includes a first contact surface and a second contact surface,
- wherein at least one of the first contact surface and the second contact surface is curved, and
- wherein the first contact surface and the second contact surface are arranged such that, during pivoting of said upper chassis section in the backwards direction, said first and second contact surfaces roll against each other providing a rolling motion between the upper chassis section and the lower chassis section in said backward direction.

2. The binding in accordance with claim 1, wherein the coupler includes at least one axle.

3. The binding in accordance with claim 2, wherein the coupler further includes at least one bushing.

4. The binding in accordance with claim 2, wherein the coupler is arranged essentially horizontally in the transverse direction of the binding.

5. The binding in accordance with claim 2, wherein at least one of the lower chassis section and the coupler is integrated with a vehicle.

6. The binding in accordance with claim 3, wherein said bushing consists of one of at least one spring and an elastic material.

7. The binding in accordance with claim 1, wherein the coupler includes at least one strap.

8. The binding in accordance with claim 1, wherein at least one of the first contact surface and the second contact surface is interchangeable.

9. The binding in accordance with claim 8, wherein at least one interchangeable contact surface includes a separate front portion and a separate rear portion.

10. The binding in accordance with claim 1, wherein the coupler is arranged essentially horizontally in the transverse direction of the binding.

11. The binding in accordance with claim 1, wherein the coupler is arranged essentially vertically in the binding.

12. The binding in accordance with claim 1, wherein the binding is arranged to be mounted on top of or below a clap binding.

13. The binding in accordance with claim 1, wherein at least one of the upper chassis section and the coupler is integrated with a shoe.

14. The binding in accordance with claim 1, wherein at least one of the lower chassis section and the coupler is integrated with a vehicle.

15. The binding in accordance with claim 1, wherein said first contact surface is included in the upper chassis section.

16. The binding in accordance with claim 1, wherein said second contact surface is included in the lower chassis section.

17. A binding for a vehicle, such as a skate for skating on ice or a ski, comprising:
- an upper chassis section;
- a lower chassis section; and
- a coupler,
- wherein the upper chassis section and the lower chassis section are engaged via the coupler, and are pivotally arranged relative to each other in the longitudinal direction of the vehicle,
- wherein the binding further includes a first contact surface and a second contact surface,
- wherein at least one of the first contact surface and the second contact surface is curved, wherein the first contact surface and the second contact surface are arranged such that, during pivoting of said upper chassis section and said lower chassis section relative to each other, at least a portion of said first contact surface is in contact with at least a portion of said second contact surface,
- wherein at least one of the first contact surface and the second contact surface is interchangeable, and
- wherein at least one interchangeable contact surface is movable in relation to one of the upper chassis section and the lower chassis section in the longitudinal direction of the vehicle.

18. A binding for a vehicle, such as a skate for skating on ice or a ski, comprising:
- an upper chassis section;
- a lower chassis section; and
- a coupler,
- wherein the upper chassis section and the lower chassis section are engaged via the coupler, and are pivotally arranged relative to each other in the longitudinal direction of the vehicle,
- wherein the binding further includes a first contact surface and a second contact surface,
- wherein at least one of the first contact surface and the second contact surface is curved, and wherein the first contact surface and the second contact surface are arranged such that, during pivoting of said upper chassis section and said lower chassis section relative to each other, at least a portion of said first contact surface is in contact with at least a portion of said second contact surface, and wherein the binding further includes a separate intermediate element arranged between the upper chassis section and the lower chassis section, which intermediate element includes an upper contact surface, which constitutes a further second contact surface, and a lower contact surface, which constitutes a further first contact surface, wherein at least one of said upper and lower contact surfaces is curved.

19. A ski, a skate for skating on ice, or shoe comprising:

a binding, the binding including, an upper chassis section, a lower chassis section, and a coupler, wherein the upper chassis section and the lower chassis section are engaged via the coupler, and are pivotally arranged relative to each other in the longitudinal direction of the vehicle, wherein the upper chassis section is pivotable at least in a backwards direction in relation to a neutral position of the upper chassis section and the lower chassis section, wherein the binding further includes a first contact surface and a second contact surface, wherein at least one of the first contact surface and the second contact surface is curved, and wherein the first contact surface and the second contact surface are arranged such that, during pivoting of said upper chassis section in the backwards direction, said first and second contact surfaces roll against each other providing a rolling motion between the upper chassis section and the lower chassis section in said backward direction.

* * * * *